US007509967B2

(12) United States Patent
Kim

(10) Patent No.: US 7,509,967 B2
(45) Date of Patent: Mar. 31, 2009

(54) TENT AND FRAME FOR AUTOMATIC UMBRELLA STYLE CANOPY TENT

(75) Inventor: Soo-Hwan Kim, Bucheon-si (KR)

(73) Assignee: Byung-Oh Cho, Daejeon-si (KR)

( * ) Notice: Subject to any disclaimer, the term of this patent is extended or adjusted under 35 U.S.C. 154(b) by 156 days.

(21) Appl. No.: 10/543,161

(22) PCT Filed: Apr. 21, 2005

(86) PCT No.: PCT/KR2005/001156

§ 371 (c)(1),
(2), (4) Date: Jul. 20, 2005

(87) PCT Pub. No.: WO2006/101288

PCT Pub. Date: Sep. 28, 2006

(65) Prior Publication Data

US 2007/0051398 A1 Mar. 8, 2007

(30) Foreign Application Priority Data

Mar. 25, 2005 (KR) ..... 10-2005-0024829

(51) Int. Cl.
*E04H 15/28* (2006.01)

(52) U.S. Cl. ..... 135/135; 135/98; 135/156; 135/120.2

(58) Field of Classification Search ..... 135/135–136, 135/156, 159, 98, 120.2, 29, 31, 906
See application file for complete search history.

(56) References Cited

U.S. PATENT DOCUMENTS 2,948,287 A * 8/1960 Rupert ..... 135/126

(Continued)

FOREIGN PATENT DOCUMENTS

DE 3600238 A1 * 7/1987

(Continued)

OTHER PUBLICATIONS

PCT/KR2005/001156 International Search Report.

(Continued)

*Primary Examiner*—Winnie Yip
(74) *Attorney, Agent, or Firm*—Schmeiser, Olsen & Watts LLP

(57) ABSTRACT

A frame for automatic umbrella style canopy tents and a tent including the frame are disclosed. In the tent frame, the spreaders, which expand or collapse the upper ribs in radial directions, are configured as extendible members, thus reliably locking the tent frame in an expanded state and securely maintaining a pitched state of the tent. In the tent frame of the present invention, each of the spreaders includes a first spreader part coupled to the upper rib and a second spreader part which is coupled to a spreader holder and into which the first spreader part is inserted such that the first spreader part is extendible, with a spring installed in the second spreader part and causing the first spreader part to be extended. A repulsive force, which acts both on the first and on the second spreader parts due to the restoring force of the spring when the tent is pitched, restricts the movement of the spreader holder, thus securely maintaining a locked state of the tent frame, so that the pitched tent can be prevented from being undesirably closed.

3 Claims, 15 Drawing Sheets

U.S. PATENT DOCUMENTS 3,693,641 A * 9/1972 Moss ..... 135/127
3,794,054 A * 2/1974 Watts ..... 135/98
3,929,146 A * 12/1975 Maiken ..... 135/98
4,202,363 A * 5/1980 Watts et al. ..... 135/98
5,284,172 A * 2/1994 Teate, Jr. ..... 135/27
5,333,634 A * 8/1994 Taylor ..... 135/98
5,479,954 A * 1/1996 Lin ..... 135/98
5,499,646 A * 3/1996 Lee ..... 135/121
5,564,453 A * 10/1996 Steiner ..... 135/98
6,006,770 A * 12/1999 Lin et al. ..... 135/33.7
6,021,795 A * 2/2000 Long et al. ..... 135/98
6,199,572 B1 * 3/2001 Rousselle et al. ..... 135/128
6,581,617 B2 * 6/2003 Ham et al. ..... 135/135
6,904,923 B2 * 6/2005 Chai et al. ..... 135/88.09
2007/0051399 A1 * 3/2007 Jung ..... 135/135

FOREIGN PATENT DOCUMENTS

DE 3708921 A1 * 9/1988
JP 09144383 A * 6/1997
KR 1991-0005932 4/1991
KR 2003-0306143 1/2003
KR 2003-0314952 3/2003
KR 2005-0373088 1/2005

OTHER PUBLICATIONS

PCT/KR2005/001156 Written Opinion.

* cited by examiner

TENT AND FRAME FOR AUTOMATIC UMBRELLA STYLE CANOPY TENT

BACKGROUND OF THE INVENTION

1. Field of the Invention

The present invention relates, in general, to frames for automatic umbrella style canopy tents and tents including the frames and, more particularly, to a frame for automatic umbrella style canopy tents and a tent including the frame, which is configured to be expanded or collapsed in a manner similar to the motion of a conventional umbrella, and in which spreaders, coupled at first ends thereof to a spreader holder and coupled at second ends thereof to upper ribs, thus expanding or collapsing the upper ribs in radial directions in response to upward or downward movement of the spreader holder, are configured as extendible members, thus allowing a user to easily and quickly pitch or close the tent without applying strong force to the frame, and reliably locking the tent frame in an expanded state, thereby securely maintaining the pitched state of the tent even if excessively high external force is applied to the pitched tent.

2. Description of the Related Art

Generally, so-called "canopy tents" among a variety of conventional tents used for outdoor activities, such as camping, are specifically designed tents of a new idea, which are configured to be easily and quickly pitched or closed, thus being convenient to users.

The canopy tents are also called "collapsible tents" or "folding tents". The canopy tents can be automatically and quickly pitched or closed when the tent frames are expanded or collapsed by users at desired places, so that the canopy tents can be called "automatic tents", and contribute to the convenience of users.

Conventional automatic tents have been classified into several types. As an example, a conventional automatic umbrella style canopy tent configured to be pitched or closed in a manner similar to the motion of a conventional automatic umbrella will be described herein below.

FIG. 1 is an exploded perspective view illustrating a conventional frame for automatic umbrella style canopy tents. FIG. 2 is a front view illustrating an automatic umbrella style canopy tent having the above-mentioned frame when the tent is fully pitched. FIG. 3 is a front view illustrating the automatic umbrella style canopy tent having the frame when the tent is collapsed.

As shown in the drawings, the conventional frame for automatic umbrella style canopy tents is a collapsible frame comprising a rib holder 12, with a plurality of upper ribs 1 coupled by hinges to the upper end of the rib holder 12 in radial directions such that the upper ribs 1 can be extended in radial directions when pitching the tent. A stopper 20 is mounted to the lower end of the rib holder 12. Integrally formed at the lower end of the rib holder 12 is a rope connector 14 to hold a tension rope 31 extending from the center of the ceiling part of the canopy of the tent 30 as shown in FIG. 2.

A spreader holder 16 is movably fitted over a shank part of the rib holder 12 such that the spreader holder 16 is movable upwards and downwards along the shank part of the rib holder 12. A plurality of collapsible spreaders 2 is coupled by hinges to the external surface of the spreader holder 16 in radial directions so that the spreaders 2 can be extended in radial directions when pitching the tent. The spreaders 2 are also coupled to respective hinge joints of the upper ribs 1.

An elastic spring 18 is fitted over the shank part of the rib holder 12, and elastically biases the spreader holder 16, thus maintaining a predetermined gap between the spreader holder 16 and the top end of the rib holder 12 when the tent is in a pitched state.

The operation of the automatic umbrella style canopy tent with the conventional frame having the above-mentioned construction will be described herein below.

FIG. 2 is a front view illustrating an automatic umbrella style canopy tent having the conventional frame when the tent is fully pitched. FIG. 3 is a front view illustrating the automatic umbrella style canopy tent having the conventional frame when the tent is collapsed.

When a user desires to close the pitched tent 30, the conventional frame is manipulated as follows.

To close the pitched tent, a user holds any two diametrically opposite upper ribs 1 at positions around the lower parts of the upper ribs 1, and forces the two selected upper ribs 1 inwards and downwards. Thus, the lower parts of all of the upper ribs 1 are collapsed downwards and closed at the same time.

After all of the upper ribs 1 have been completely closed, a plurality of lower ribs 3 coupled to the upper ribs 1 by the hinge joints is folded upwards around the joints, so that the tent 30 is completely collapsed (see FIG. 3).

During the above-mentioned tent collapsing action, the spreader holder 16, movably fitted over the shank part of the rib holder 12, is moved upwards along the shank part of the rib holder as it is forced upwards by the spreaders 2 coupled by the hinge joints to the upper ribs 1. The spreader holder 16 thus reaches an upper position on the rib holder 12.

During the above-mentioned upward movement of the spreader holder 16 along the shank part of the rib holder 12, the spreader holder compresses the spring 18 which is fitted over the shank part of the rib holder 12 at the position above the spreader holder 16.

When a user desires to pitch the closed tent 30, the tent frame is manipulated as follows.

To pitch the closed tent, the user opens the folded lower ribs 3 from the closed upper ribs 1 by forcing the ends of the folded lower ribs 3 outwards and downwards, and holds any two diametrically opposite upper ribs 1 at lower parts around the hinge joints 1*a* prior to forcing the two selected upper ribs 1 upwards and outwards. When the two selected upper ribs 1 are forced upwards and outwards by the user as described above, all of the upper ribs 1 are elastically rotated upwards and fully opened at one time by the restoring force of the spring 18. Thus, the tent 30 is fully pitched (see FIG. 2).

During the above-mentioned tent pitching action, the spreader holder 16, movably fitted over the shank part of the rib holder 12, is moved downwards along the shank part by the restoring force of the spring 18. The downward movement of the spreader holder 16 along the rib holder 12 extends the spreaders 2, while the extending action of the spreaders 2 promotes the extending action of the upper ribs 1.

When the user applies downward pressure to the spreader holder 16 after the tent 30 has been fully pitched, the spreader holder 16 is moved downwards along the shank part of the rib holder 12 due both to the pressure applied by the user to the spreaders 16 and to the restoring force of the elastic spring 18.

Thus, the position of the spreaders 2 is changed to incline the spreaders 2 such that the outside ends of the spreaders 2 are positioned higher than the inside ends of the spreaders 2 coupled to the spreader holder 16. Due to the inclination of the spreaders 2, the fully extended state of the frame 10 is locked so that the frame 10 supporting the fully pitched tent 30 can be retained in its fully extended state even if an external impact is undesirably applied to the pitched tent 30.

The automatic umbrella style canopy tent having the above-mentioned conventional frame is advantageous in that the tent can be easily and quickly pitched and closed, and the frame has a simple structure. However, due to the elastic spring 18, the number of elements constituting the tent frame is increased and, furthermore, the elasticity of the spring 18 is gradually reduced by the repeated pitching and closing motion of the tent frame. The tent frame 10 is locked in its extended state due both to the gradient of the spreaders 2 and to the restoring force of the elastic spring without using a separate locking device, so that, when a strong external force is applied to the pitched tent, the tent may be collapsed (to be closed).

Furthermore, the conventional automatic umbrella style canopy tent is configured such that the tent frame is actuated by a spring, so that the tent frame must use a spring having high elasticity. The spreaders are coupled to both the spreader holder and the upper ribs without using a means for absorbing shock, so that, when a strong impact is applied to the spreaders, the spreaders may be broken and injure a user.

Therefore, in an effort to overcome the problems of the conventional automatic umbrella style canopy tent, Korean Utility Model Registration No. 0344232 (Title of the Device: Frame for Automatic Umbrella Style Canopy Tents) has been proposed. This tent frame uses an elastic spring in the same manner as the conventional frame for the automatic umbrella style canopy tent, and uses a separate locking device, so that the tent frame has an undesirably complex structure, and forces a user to repeatedly lock and unlock the tent using the locking device, thus being inconvenient to the user.

SUMMARY OF THE INVENTION

Accordingly, the present invention has been made keeping in mind the above problems occurring in the prior art, and an object of the present invention is to provide a frame for automatic umbrella style canopy tents and a tent including the frame, in which spreaders, coupled at first ends thereof to a spreader holder and coupled at second ends thereof to upper ribs, thus expanding or collapsing the upper ribs in radial directions in response to upward or downward movement of the spreader holder, are configured as extendible members, thus allowing a user to easily and quickly pitch or close the tent without applying strong force to the frame.

Another object of the present invention is to provide a frame for automatic umbrella style canopy tents and a tent including the frame, which is automatically and reliably locked in an expanded state without using a separate locking device, thereby securely maintaining the pitched state of the tent, even if excessively high external force is applied to the pitched tent, and being convenient to the user.

In order to accomplish the above objects, the present invention may provide a frame for automatic umbrella style canopy tents, comprising: a rib holder with a plurality of upper ribs rotatably coupled to the rib holder in radial directions; a connection member mounted to the rib holder; a spreader holder engaging with the connection member and being movable upwards and downwards; a plurality of spreaders each coupled at respective ends thereof to a corresponding upper rib and to the spreader holder, thus expanding or closing the upper ribs in radial directions in response to upward or downward movement of the spreader holder; and a stopper mounted to a lower end of the connection member and preventing the spreader holder from being removed from the connection member, wherein each of the spreaders comprises a first spreader part and a second spreader part into which the first spreader part is inserted such that the first spreader part is extendible, with a spring installed in the second spreader part and causing the first spreader part to be extended, so that a repulsive force acts both on the first and on the second spreader parts due to the restoring force of the spring when the tent is pitched, thus restricting a range of movement of the spreader holder, and securely maintaining a locked state of the tent frame, and preventing the pitched tent from being undesirably closed.

Furthermore, the present invention may provide a frame for automatic umbrella style canopy tents, comprising: a rib holder with a plurality of upper ribs rotatably coupled to the rib holder in radial directions; a connection member mounted to the rib holder; a spreader holder engaging with the connection member and being movable upwards and downwards; a plurality of spreaders each coupled at respective ends thereof to a corresponding upper rib and to the spreader holder, thus expanding or closing the upper ribs in radial directions in response to upward or downward movement of the spreader holder; and a stopper mounted to a lower end of the connection member and preventing the spreader holder from being removed from the connection member, wherein each of the spreaders comprises a first spreader part and a second spreader part, wherein the rear part of the first spreader part has a diameter reduced compared to a diameter of the front part of the first spreader part, and the second spreader part comprises a hollow body which has a diameter capable of receiving the rear part of the first spreader part therein such that the first spreader part is extendible, with a spring provided on the rear part of the first spreader part and causing the first spreader part to be extended, so that a repulsive force acts both on the first and on the second spreader parts due to the restoring force of the spring when the tent is pitched, thus restricting a range of movement of the spreader holder, and securely maintaining a locked state of the tent frame, and preventing the pitched tent from being undesirably closed.

Furthermore, the present invention may provide a frame for automatic umbrella style canopy tents, comprising: a rib holder with a plurality of upper ribs rotatably coupled to the rib holder in radial directions; a connection member mounted to the rib holder; a spreader holder engaging with the connection member and being movable upwards and downwards; a plurality of spreaders each coupled at respective ends thereof to a corresponding upper rib and to the spreader holder, thus expanding or closing the upper ribs in radial directions in response to upward or downward movement of the spreader holder; and a stopper mounted to a lower end of the connection member and preventing the spreader holder from being removed from the connection member, wherein each of the spreaders comprises: front and rear stoppers provided at front and rear ends of the spreader, respectively; a movable block provided on the spreader at a position between the front and rear stoppers and integrated with a coupling rod coupled to each of the upper ribs; and a spring provided on the spreader at a position behind the movable block, thus allowing the movable block to be movable, so that a repulsive force acts both on the coupling rod of the movable block and on the spreader due to the restoring force of the spring when the tent is pitched, thus restricting a range of movement of the spreader holder, and securely maintaining a locked state of the tent frame, and preventing the pitched tent from being undesirably closed.

In addition, the frame may further comprise: a rope connector mounted to the lower end of the stopper and holding a tension rope which extends from the center of a ceiling part of a canopy of the tent, thus preventing the center of the ceiling part of the canopy from sagging when the tent is pitched.

Furthermore, the present invention may also provide an automatic umbrella style canopy tent comprising the above-mentioned frame.

The frame for automatic umbrella style canopy tents and the canopy tent including the frame according to the present invention are advantageous in that the spreaders to expand or collapse the upper ribs in radial directions in response to upward or downward movement of the spreader holder are configured as extendible members, thus allowing a user to easily and quickly pitch or close the tent. Furthermore, the tent frame is automatically and reliably locked in an expanded state without using a separate locking device, thereby securely maintaining the pitched state of the tent, even if excessively high external force is applied to the pitched tent, and being convenient to the user.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
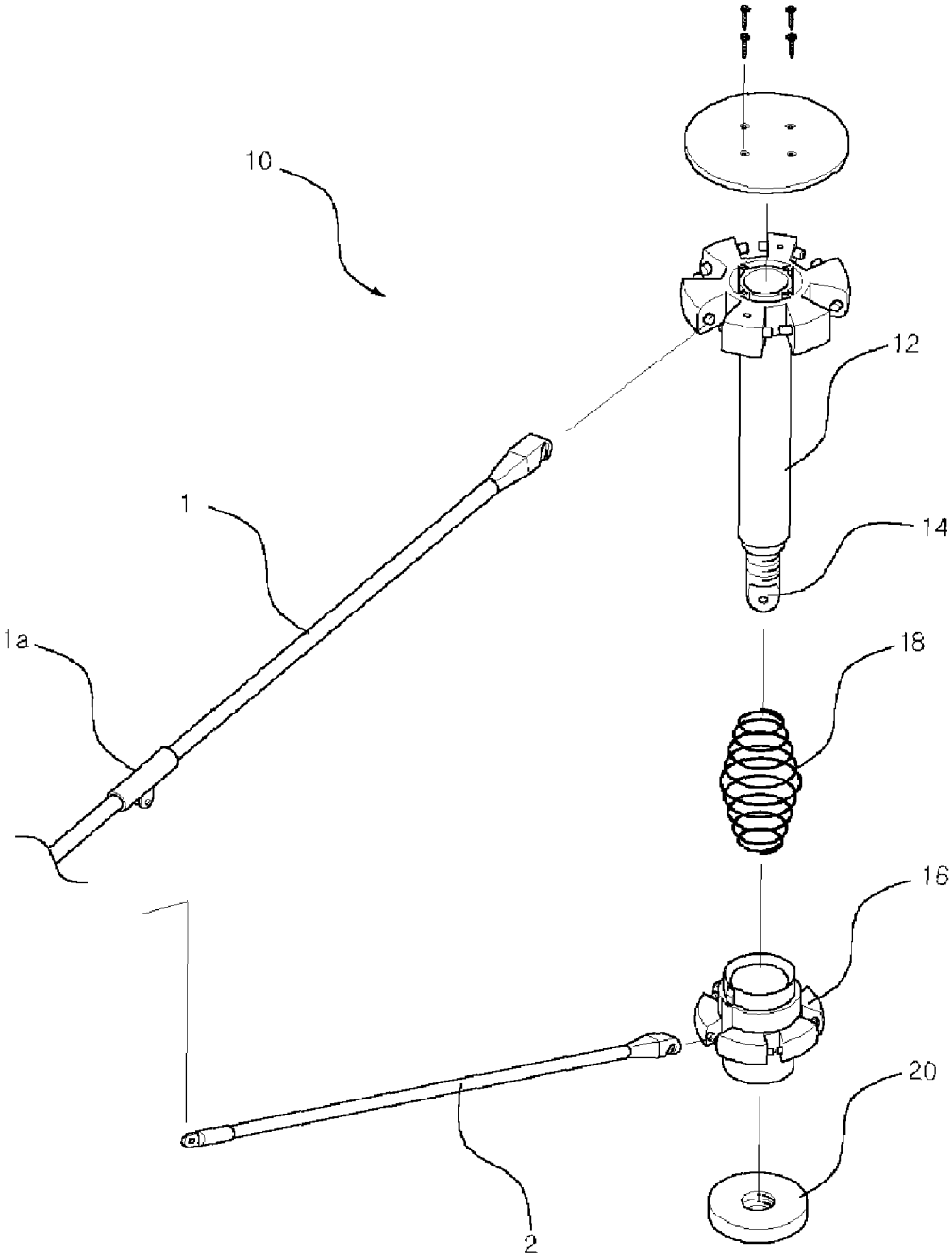
FIG. 1 PRIOR ART
FIG. 1 is an exploded perspective view illustrating a conventional frame for automatic umbrella style canopy tents.
Figure 2:
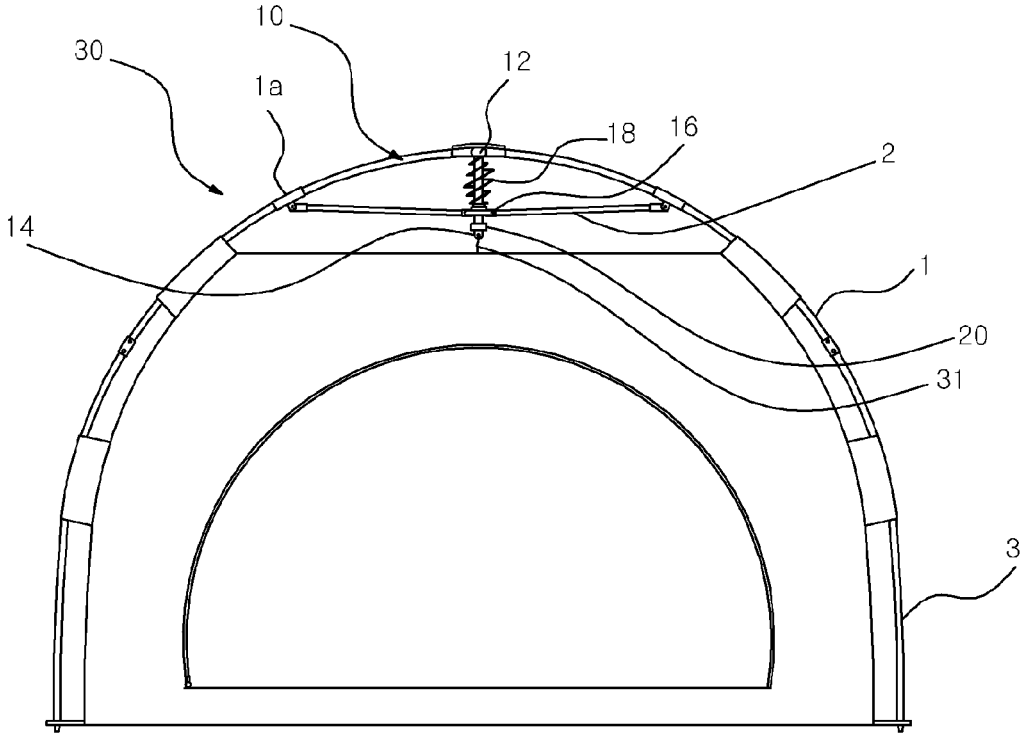
FIG. 2 PRIOR ART
FIG. 2 is a front view illustrating an automatic umbrella style canopy tent having the conventional frame when the tent is fully pitched.
Figure 3:
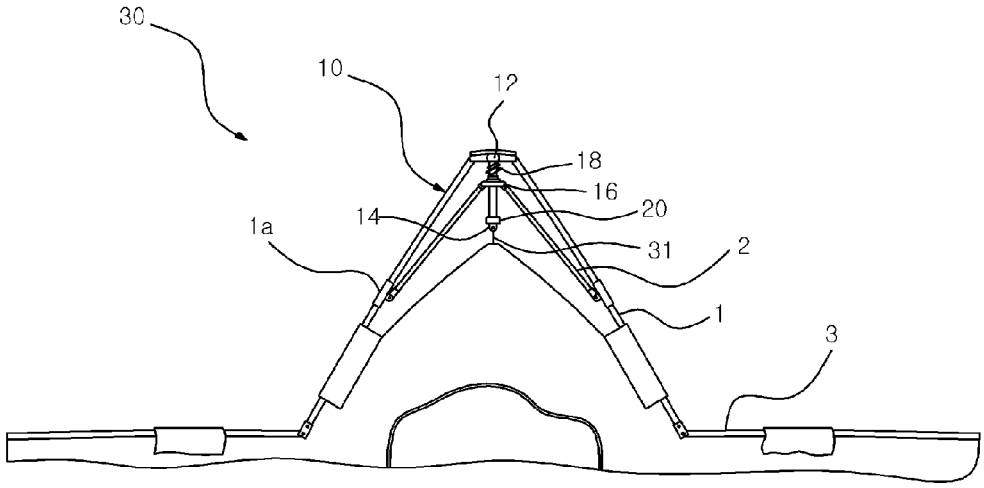
FIG. 3 PRIOR ART
FIG. 3 is a front view illustrating the automatic umbrella style canopy tent having the conventional frame when the tent is collapsed.

The above and other objects, features and other advantages of the present invention will be more clearly understood from the following detailed description taken in conjunction with the accompanying drawings, in which the same reference numerals are used throughout the different drawings to designate the same or similar components.

Herein below, preferred embodiments of the present invention will be described in detail with reference to the accompanying drawings.

Figure 4:
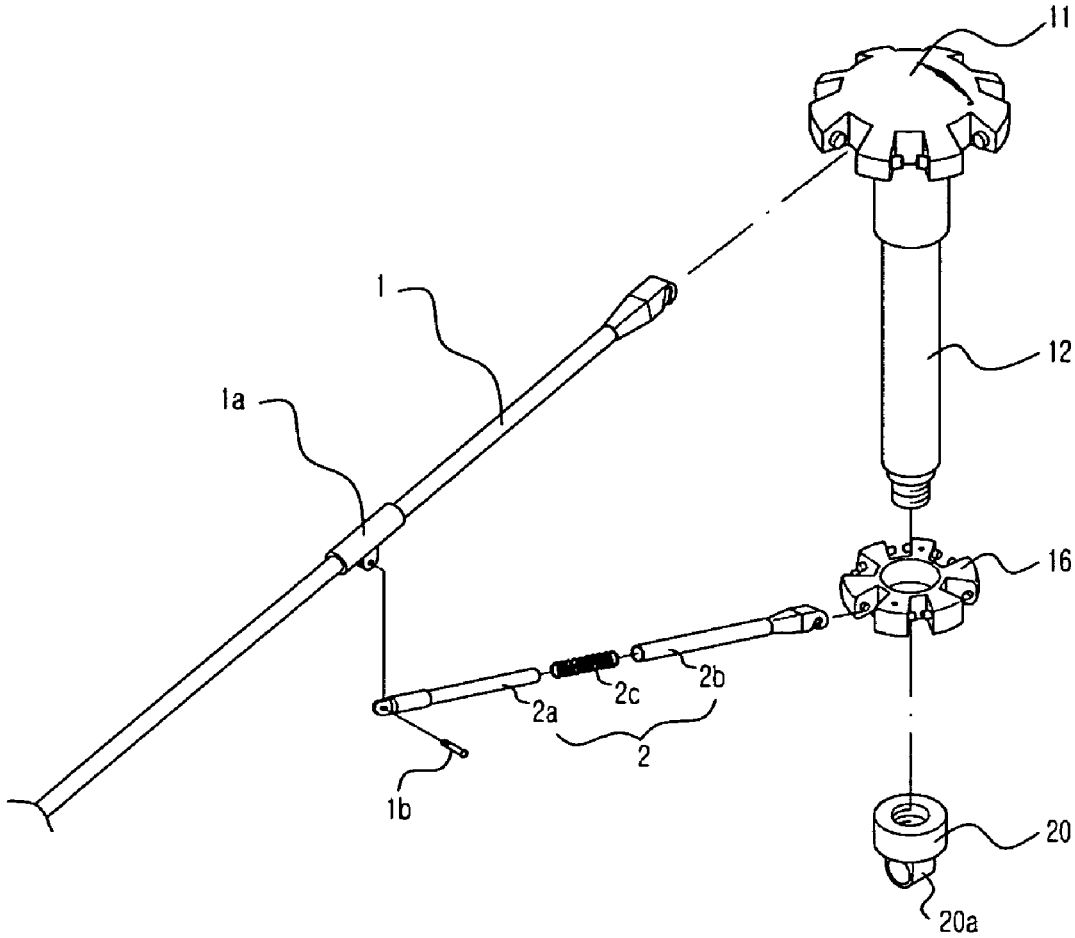
FIG. 4 is an exploded perspective view illustrating important elements of a frame for automatic umbrella style canopy tents, according to a first embodiment of the present invention.
Figure 5:
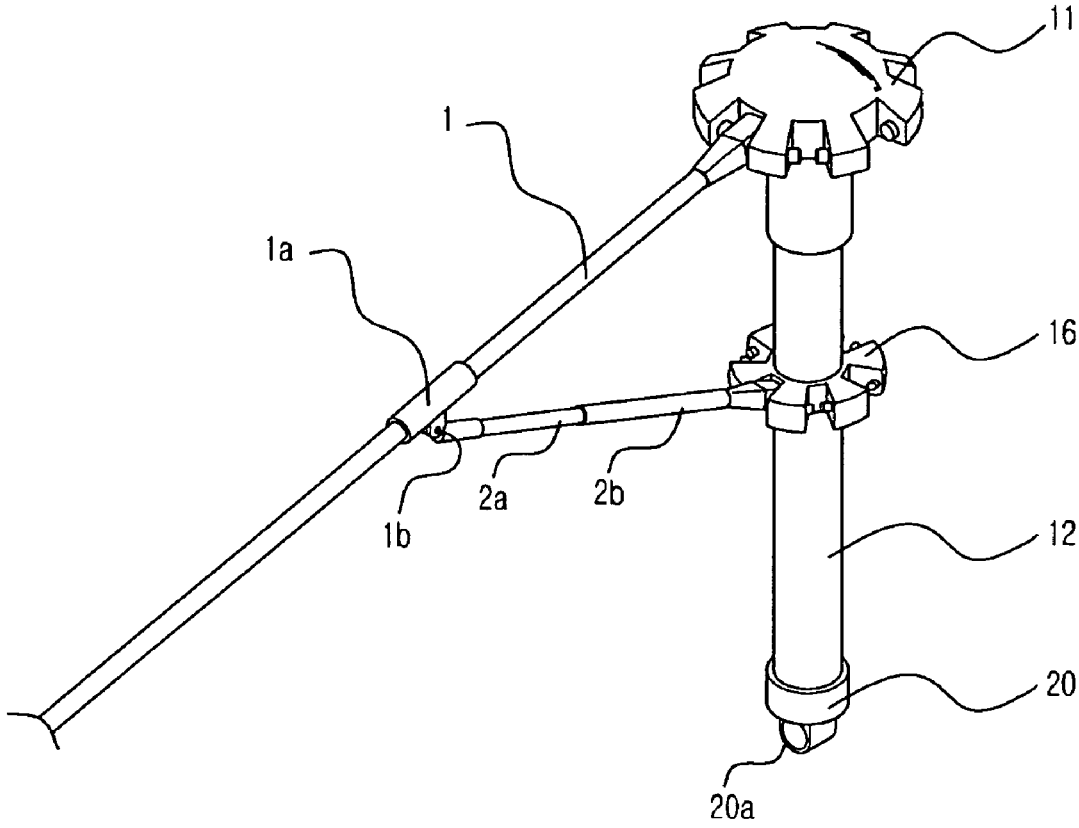
FIG. 5 is a perspective view illustrating the assembled frame of FIG. 4.

FIG. 4 is an exploded perspective view illustrating important elements of a frame for automatic umbrella style canopy tents, according to a first embodiment of the present invention. FIG. 5 is a perspective view illustrating the assembled frame of FIG. 4.

As shown in the drawings, the frame for automatic umbrella style canopy tents according to the first embodiment of the present invention comprises a rib holder 11, with a plurality of upper ribs 1 rotatably coupled to the rib holder 11 in radial directions. A connection member 12 is mounted to the rib holder 11. Further, a spreader holder 16 is movably fitted over a shank part of the connection member 12 such that the spreader holder 16 is movable upwards and downwards along the shank part of the connection member 12. A plurality of spreaders 2 is coupled at first ends thereof to the spreader holder 16 and coupled by hinge joints 1*a* at second ends thereof to the upper ribs 1, thus expanding or collapsing the upper ribs 1 in radial directions in response to the upward or downward movement of the spreader holder 16. Further, a stopper 20 is detachably mounted to the lower end of the connection member 12 and prevents the spreader holder 16 from being removed from the connection member 12. Each of the spreaders 2 comprises a first spreader part 2*a* which is coupled to the hinge joint 1*a* of the upper rib 1, and a second spreader part 2*b* which is coupled to the spreader holder 16. The second spreader part 2*b* is configured as a hollow pipe body which has a diameter sufficiently large to axially receive the first spreader part 2*a* therein and form an extendible structure. A spring 2*c* is installed in the hollow body of the second spreader part 2*b* and allows the first spreader part 2*a* to form the extendible structure.

Figure 6:
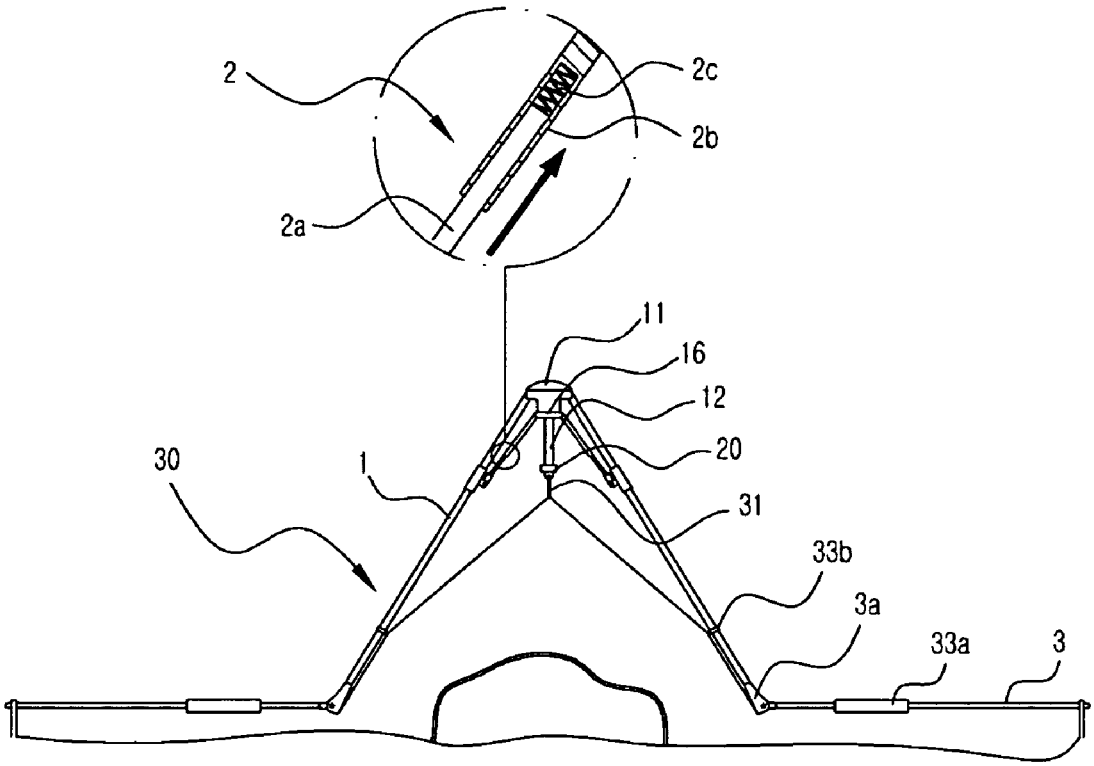
FIG. 6 is a front view illustrating the frame according to the first embodiment of the present invention when a tent having the frame is collapsed.
Figure 7:
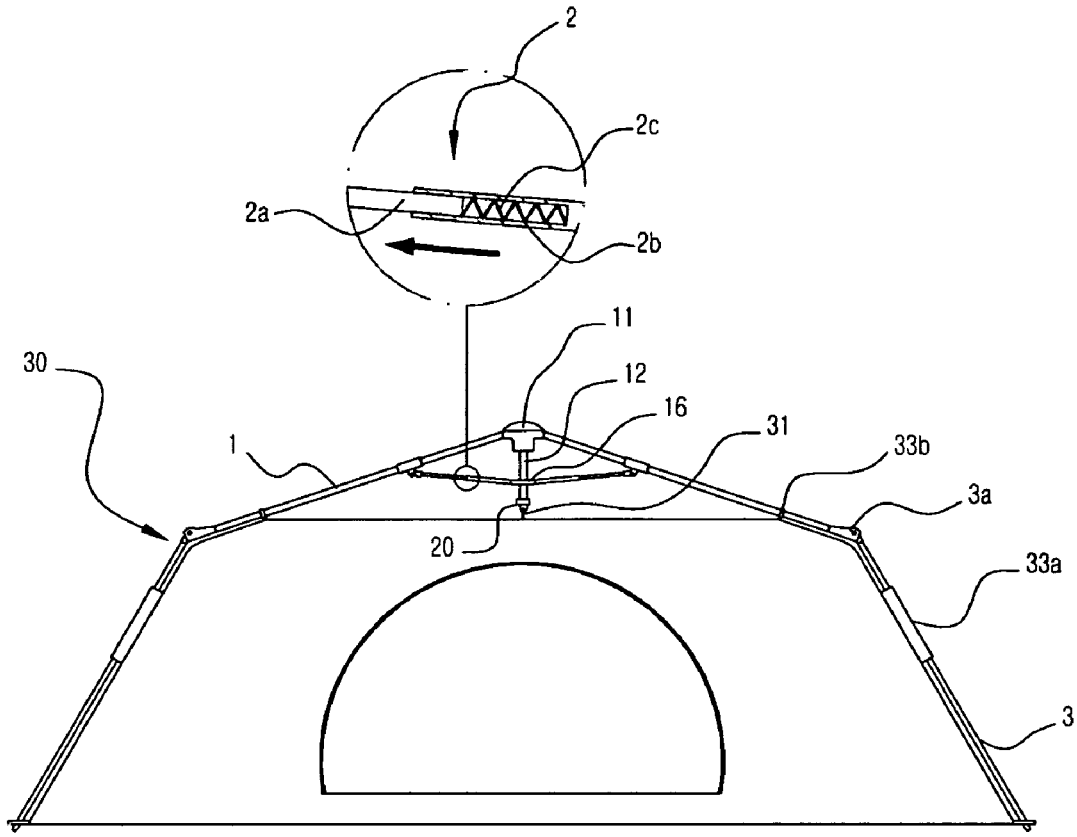
FIG. 7 is a front view illustrating the frame according to the first embodiment of the present invention when the tent having the frame is fully pitched.

In the meantime, integrally mounted to the lower end of the stopper 20 is a rope connector 20*a* to hold a tension rope 31 which extends from the center of the ceiling part of the canopy of the tent 30, as shown in FIGS. 6 and 7. Thus, the rope connector 20*a* prevents the center of the ceiling part of the canopy of the tent 30 from sagging when the tent 30 is fully pitched.

The above-mentioned parts of the frame for automatic umbrella style canopy tents according to the first embodiment of the present invention are assembled with each other into a single frame as follows.

The rod-shaped connection member 12 is integrally mounted to the lower end of the rib holder 11, and the upper ribs 1 are coupled by hinges to the rib holder 11 in radial directions in the same manner as that described for the conventional tent frame. A hinge joint 1*a* is mounted to the upper part of each of the upper ribs 1.

Further, a lower rib 3 is coupled to the lower end of each of the upper ribs 1 by a hinge joint 3*a* having the same structure as a conventional hinge joint as shown in FIGS. 6 and 7, so that the lower ribs 3 can be folded upwards around the hinge joints 3*a*.

The spreader holder 16 integrated with a plurality of hinge block parts is movably fitted over the shank part of the connection member 12. The second spreader parts 2*b* are thus coupled by hinges to the block parts of the spreader holder 16, while the first spreader parts 2*a* are coupled to the hinge joints 1*a* of the upper ribs 1 using a plurality of locking pins 1*b*.

The springs 2*c* are installed in the hollow bodies of the second spreader parts 2*b* and allow the first spreader parts 2*a* to be inserted into the hollow bodies of the second spreader parts 2*b* while compressing the springs 2*c*, thus obtaining the assembled structure as shown in FIG. 5.

Thereafter, the stopper 20 is mounted to the lower end of the connection member 12, thus preventing the spreader holder 16 from being undesirably removed from the connection member 12.

After the parts of the tent frame have been completely assembled into a single body as described above, a canopy of the tent 30 is attached to the frame using both rib insert flaps 33*a* and hanging rings 33*b*. Thereafter, a tension rope 31, extending from the center of the ceiling part of the canopy of the tent 30, is connected to the rope connector 20*a* that is integrally mounted to the lower end of the stopper 20, so that the center of the ceiling part of the canopy of the tent 30 can be prevented from sagging when the tent 30 is fully pitched, as shown in FIGS. 6 and 7.

The operation of the automatic umbrella style canopy tent having the above-mentioned construction will be described herein below.

FIG. 6 is a front view illustrating the automatic umbrella style canopy tent having the frame according to the first embodiment of the present invention when the tent is collapsed. FIG. 7 is a front view illustrating the automatic umbrella style canopy tent having the frame according to the first embodiment of the present invention when the tent is fully pitched.

When a user desires to close the pitched tent, the tent frame according to the first embodiment of the present invention is manipulated as follows.

As shown in FIG. 6, to close the pitched tent, a user holds any two diametrically opposite upper ribs 1 at positions around the lower parts of the upper ribs 1, and forces the two selected upper ribs 1 inwards and downwards. Thus, all of the upper ribs 1 are moved inwards and downwards, thereby being collapsed.

After all of the upper ribs 1 have been collapsed, the lower ribs 3 coupled to the upper ribs 1 by the hinge joints 3*a* are folded around the joints 3*a*, thus completely collapsing the tent 30.

During the above-mentioned tent collapsing action, in which the user holds the lower parts of any two diametrically opposite upper ribs 1 and forces the two selected upper ribs 1 inwards and downwards, the spreader holder 16, fitted over the shank part of the connection member 12 and movable upwards and downwards along the shank part, is moved upwards along the shank part as it is forced upwards by the spreaders 2 coupled by hinges to the upper ribs 1.

During the above-mentioned action (the action of closing the upper ribs), the first spreader part 2*a* of each spreader 2 is elastically inserted into the hollow body of the second spreader part 2*b* (as shown by the arrow of FIG. 6) while compressing the spring 2*c* due to the folding force of the upper ribs 1.

When a user desires to pitch the closed tent, the tent frame is manipulated as follows.

As shown in FIG. 7, to pitch the closed tent which is in contact with the upper ribs 1 (in the state of FIG. 6), the user opens the folded lower ribs 3 from the closed upper ribs 1 by forcing the ends of the folded lower ribs 3 outwards and downwards, and holds any two diametrically opposite upper ribs 1 at lower parts of the upper ribs 1 prior to forcing the two selected upper ribs 1 upwards and outwards. When the two selected upper ribs 1 are forced upwards and outwards by the user as described above, the spreader holder 16 is moved downwards along the shank part of the connection member 12. During the downward movement of the spreader holder 16 along the shank part of the connection member, the spreader holder 16 pushes the spreaders 2 toward the upper ribs 1.

In the above case, the first spreader parts 2*a*, which have compressed the springs 2*c* in the hollow bodies of the second spreader parts 2*b* as shown in FIG. 6, move outwards in the hollow bodies of the second spreader parts 2*b* (as shown by the arrow of FIG. 7) due to the restoring force of the springs 2*c*. Due to the above-mentioned movement of the first spreader parts 2*a*, the upper ribs 1 naturally expand in radial directions.

In other words, because the folding force of the upper ribs 1 is removed, the first spreader parts 2*a* are elastically pushed by the restoring force of the springs 2*c* and bias the upper ribs 1 upwards and outwards.

Thus, all of the upper ribs 1 are elastically rotated upwards around the hinges of the rib holder 11 and are fully opened at one time, so that the automatic umbrella style canopy tent 30 is fully pitched.

As shown in FIG. 7, because a repulsive force acts both on the first and on the second spreader parts 2*a* and 2*b* due to the restoring force of the spring 2*c* when the tent 30 is in a fully pitched state, the spreader holder 16 can be prevented from being undesirably moved upwards.

In other words, the repulsive force, which acts both on the first and on the second spreader parts 2*a* and 2*b* due to the restoring force of the spring 2*c* when the tent is pitched, restricts upward movement of the spreader holder 16, thus securely maintaining the locked state of the tent frame, so that the pitched tent 30 can be prevented from being undesirably closed.

Herein below, a second embodiment of the present invention will be described with reference to the accompanying drawings.

Figure 8:
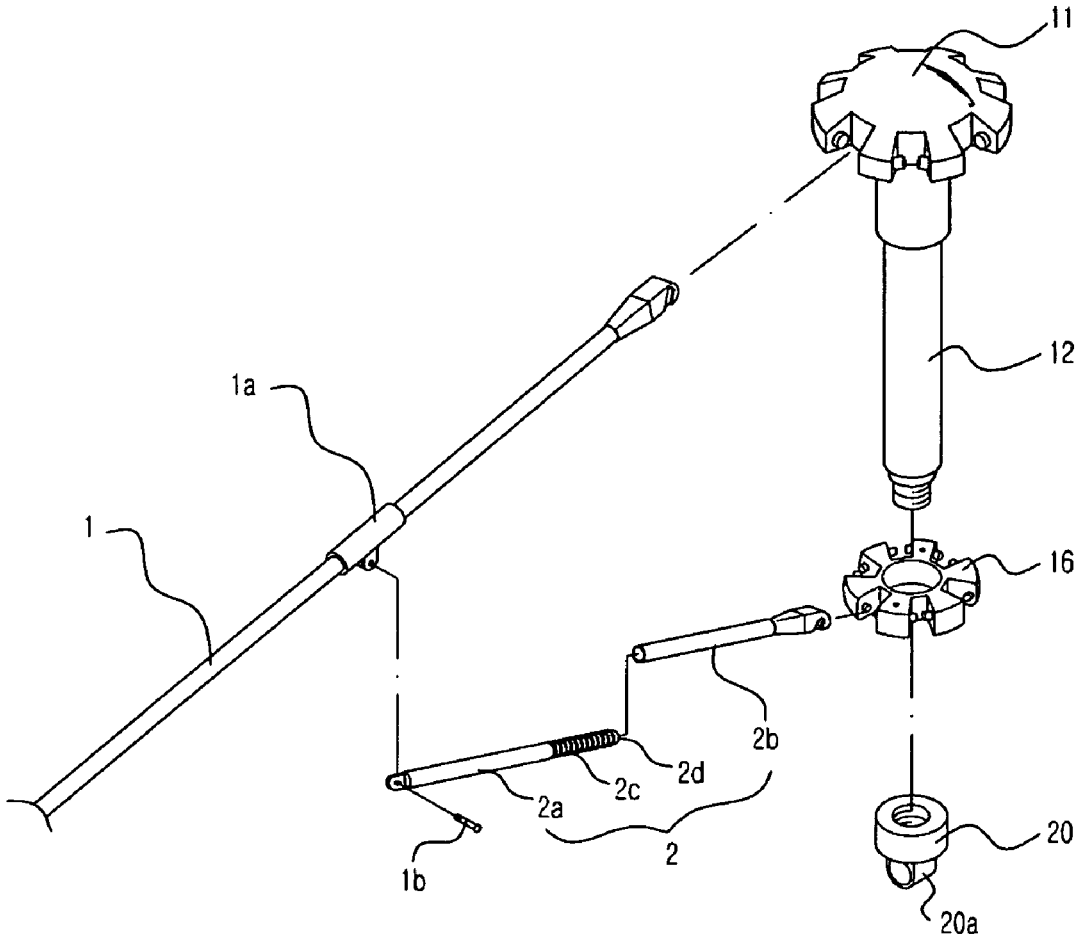
FIG. 8 is an exploded perspective view illustrating important elements of a frame for automatic umbrella style canopy tents, according to a second embodiment of the present invention.
Figure 9:
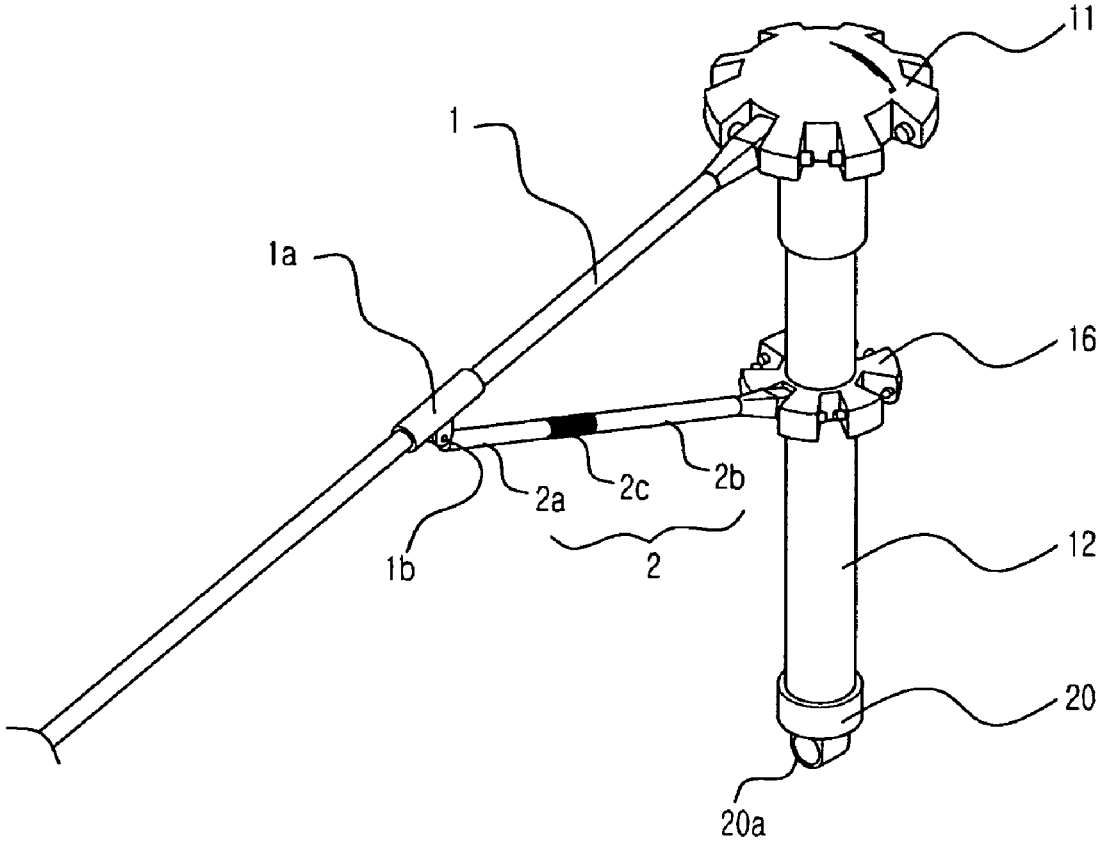
FIG. 9 is a perspective view illustrating the assembled frame of FIG. 8.

FIG. 8 is an exploded perspective view illustrating the important elements of a frame for automatic umbrella style canopy tents, according to the second embodiment of the present invention. FIG. 9 is a perspective view illustrating the assembled frame of FIG. 8.

As shown in the drawings, the general shape of the frame for automatic umbrella style canopy tents according to the second embodiment of the present invention remains the same as that described for the first embodiment, but each of the spreaders 2 comprises a first spreader part 2*a* which is coupled to the hinge joint 1*a* of the upper rib 1, and a second spreader part 2*b* which is coupled to the spreader holder 16. The rear part 2*d* of the first spreader part 2*a* is configured such that the diameter of the rear part 2*d* is reduced compared to the diameter of the front part, while the second spreader part 2*b* is configured as a hollow pipe body which has a diameter sufficiently large to axially receive the rear part 2*d* of the first spreader part 2*a* therein and form an extendible structure. A spring 2*c* is fitted over the rear part 2*d* of the first spreader part 2*a*, thus allowing the first and second spreader parts 2*a* and 2*b* to form an extendible structure.

In the same manner as that described for the first embodiment of the present invention, the frame for automatic umbrella style canopy tents according to the second embodiment of the present invention includes the spreader holder 16 which is integrated with a plurality of hinge block parts and is movably fitted over the shank part of the connection member 12. The second spreader parts 2*b* are thus coupled by hinges to the block parts of the spreader holder 16, while the first spreader parts 2*a* are coupled to the hinge joints 1*a* of the upper ribs 1 using a plurality of locking pins 1*b*.

The rear parts 2*d* of the first spreader parts 2*a* are inserted into the hollow bodies of the second spreader parts 2*b* with the springs 2*c* fitted over the rear parts 2*d* of the first spreader parts 2*a*, so that an extendible structure comprising the first and second spreader parts 2*a* and 2*b* can be provided as shown in FIG. 9.

The above-mentioned assembled structure of the spreader remains the same as that described for the first embodiment, and further explanation is thus deemed unnecessary.

The operation of the automatic umbrella style canopy tent according to the second embodiment of the present invention having the above-mentioned construction and assembled structure will be described herein below.

Figure 10:
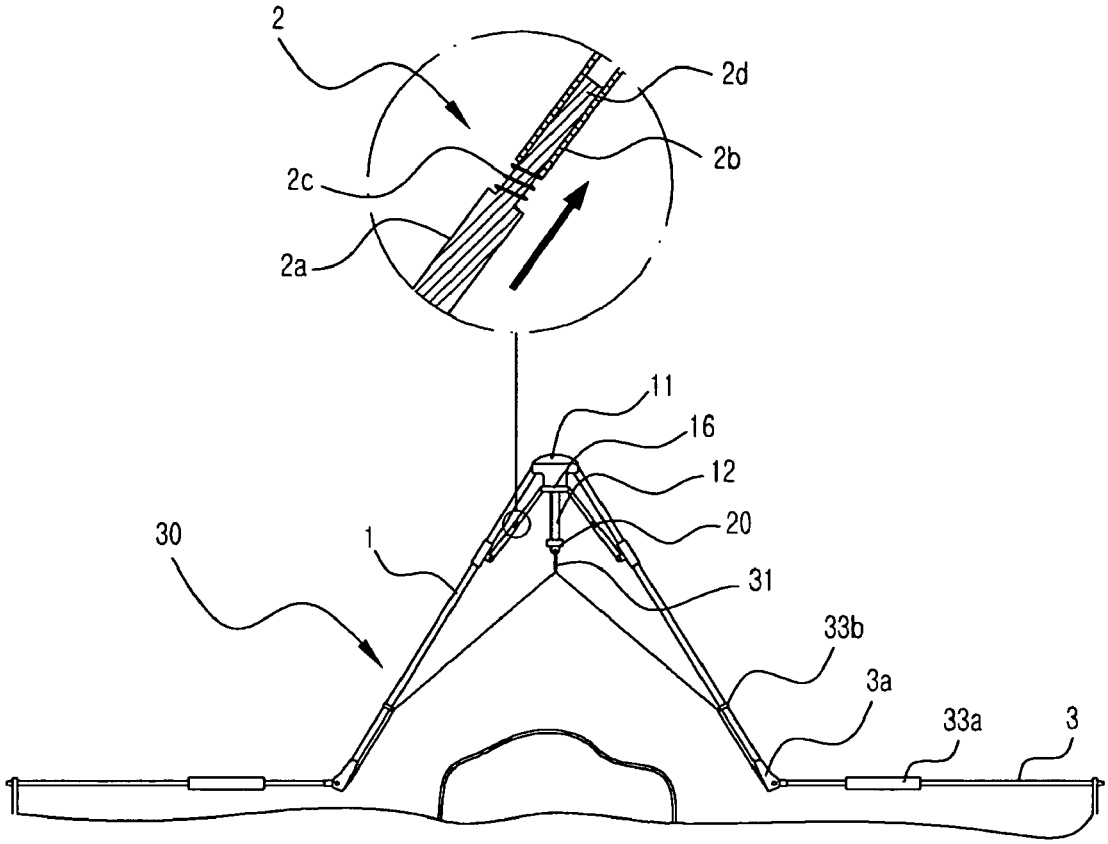
FIG. 10 is a front view illustrating the frame according to the second embodiment of the present invention when a tent having the frame is collapsed.
Figure 11:
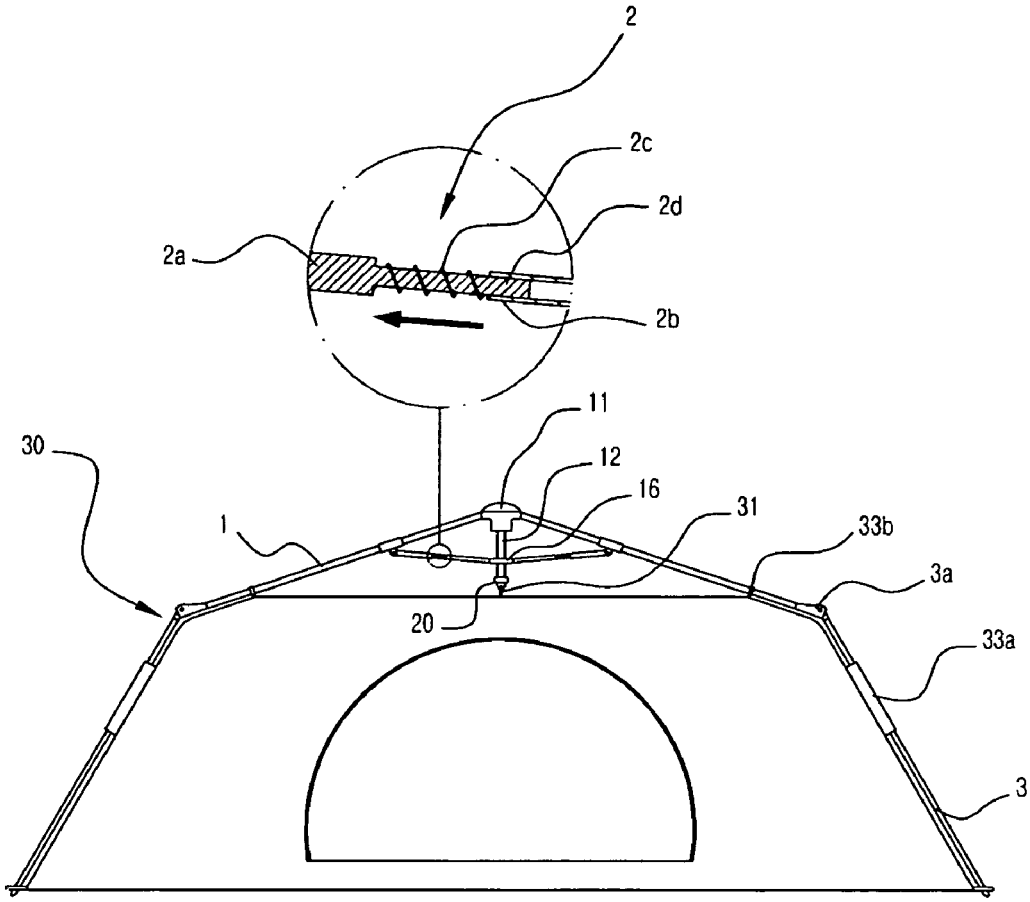
FIG. 11 is a front view illustrating the frame according to the second embodiment of the present invention when the tent having the frame is fully pitched.

FIG. 10 is a front view illustrating the automatic umbrella style canopy tent having the frame according to the second embodiment of the present invention when the tent is collapsed. FIG. 11 is a front view illustrating the automatic umbrella style canopy tent having the frame according to the second embodiment of the present invention when the tent is fully pitched.

First, when the user desires to close the pitched tent, the tent frame according to the second embodiment of the present invention is manipulated in the same manner as that described for the first embodiment.

Described in detail, to close the pitched tent, a user holds any two diametrically opposite upper ribs 1 at positions around the lower parts of the upper ribs 1, and forces the two selected upper ribs 1 inwards and downwards. In the above case, the spreader holder 16, fitted over the shank part of the connection member 12 to be movable upwards and downwards along the shank part, is moved upwards along the shank part as it is forced upwards by the spreaders 2 coupled by hinges to the upper ribs 1.

During the above-mentioned action (the action of closing the upper ribs), the rear part 2*d* of each first spreader part 2*a* is elastically inserted into the hollow body of the second spreader part 2*b* (as shown by the arrow of FIG. 10) while compressing the spring 2*c* fitted over the rear part 2*d* of the first spreader part 2*a* due to the folding force of the upper ribs 1.

When a user desires to pitch the closed tent according to the second embodiment, the tent frame is manipulated as follows.

As shown in FIG. 11, to pitch the closed tent which is in contact with the upper ribs 1 (in the state of FIG. 10), the user opens the folded lower ribs 3 from the closed upper ribs 1 by forcing the ends of the folded lower ribs 3 outwards and downwards, and holds any two diametrically opposite upper ribs 1 at lower parts of the upper ribs 1 prior to forcing the two selected upper ribs 1 upwards and outwards. When the two selected upper ribs 1 are forced upwards and outwards by the user as described above, the spreader holder 16 is moved downwards along the shank part of the connection member 12. During the downward movement of the spreader holder 16 along the shank part of the connection member, the spreader holder 16 pushes the spreaders 2 toward the upper ribs 1.

In the above case, the first spreader parts 2*a*, which have compressed the springs 2*c* as shown in FIG. 10, elastically extend outwards (as shown by the arrow of FIG. 11) from the hollow bodies of the second spreader parts 2*b* due to the restoring force of the springs 2*c*. Due to the above-mentioned movement of the first spreader parts 2*a*, the upper ribs 1 naturally expand in radial directions.

In other words, because the folding force of the upper ribs 1 is removed, the first spreader parts 2*a* are elastically pushed by the restoring force of the springs 2*c* and bias the upper ribs 1 upwards and outwards.

Thus, all of the upper ribs 1 are elastically rotated upwards around the hinges of the rib holder and are fully opened at one time, so that the automatic umbrella style canopy tent 30 is fully pitched.

As shown in FIG. 11, because a repulsive force acts both on the first and on the second spreader parts 2*a* and 2*b* due to the restoring force of the spring 2*c* when the tent 30 is in a fully pitched state, the spreader holder 16 can be prevented from being undesirably moved upwards in the same manner as that described for the first embodiment.

In other words, the repulsive force, which acts both on the first and on the second spreader parts 2*a* and 2*b* due to the restoring force of the spring 2*c* when the tent is pitched, restricts the upward movement of the spreader holder 16, thus securely maintaining the locked state of the tent frame, so that the pitched tent 30 can be prevented from being undesirably closed.

Herein below, a third embodiment of the present invention will be described with reference to the accompanying drawings.

Figure 12:
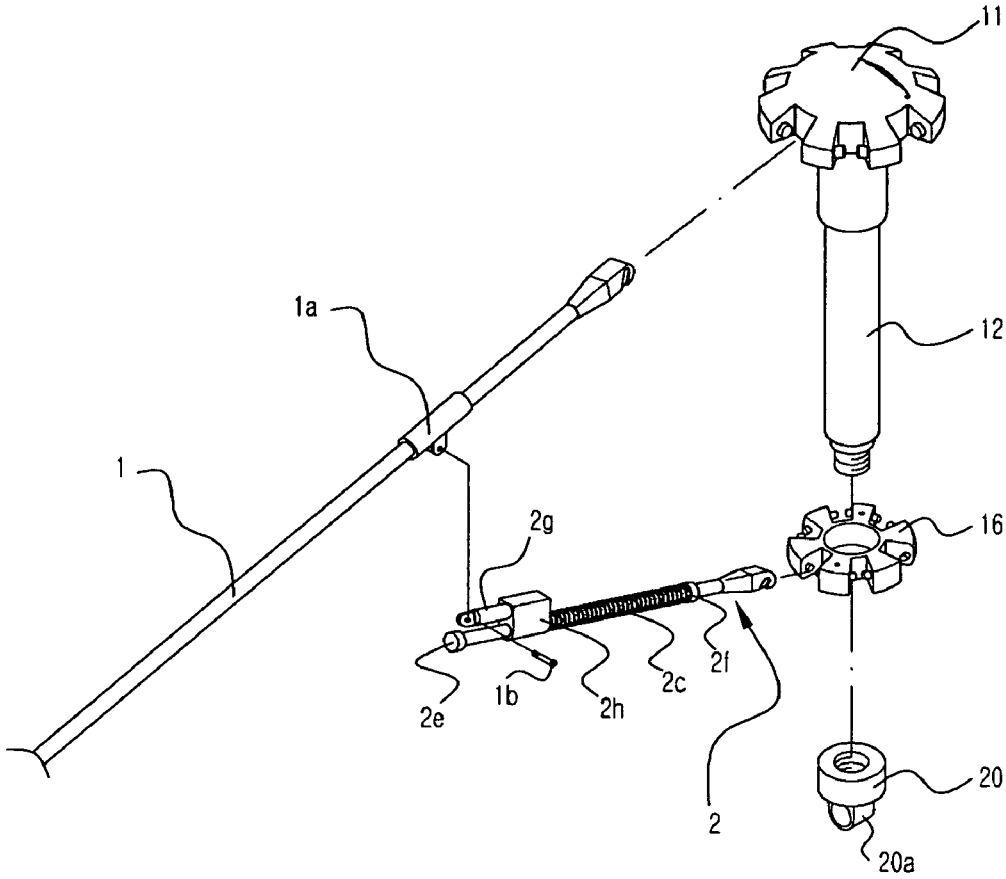
FIG. 12 is an exploded perspective view illustrating important elements of a frame for automatic umbrella style canopy tents, according to a third embodiment of the present invention.
Figure 13:
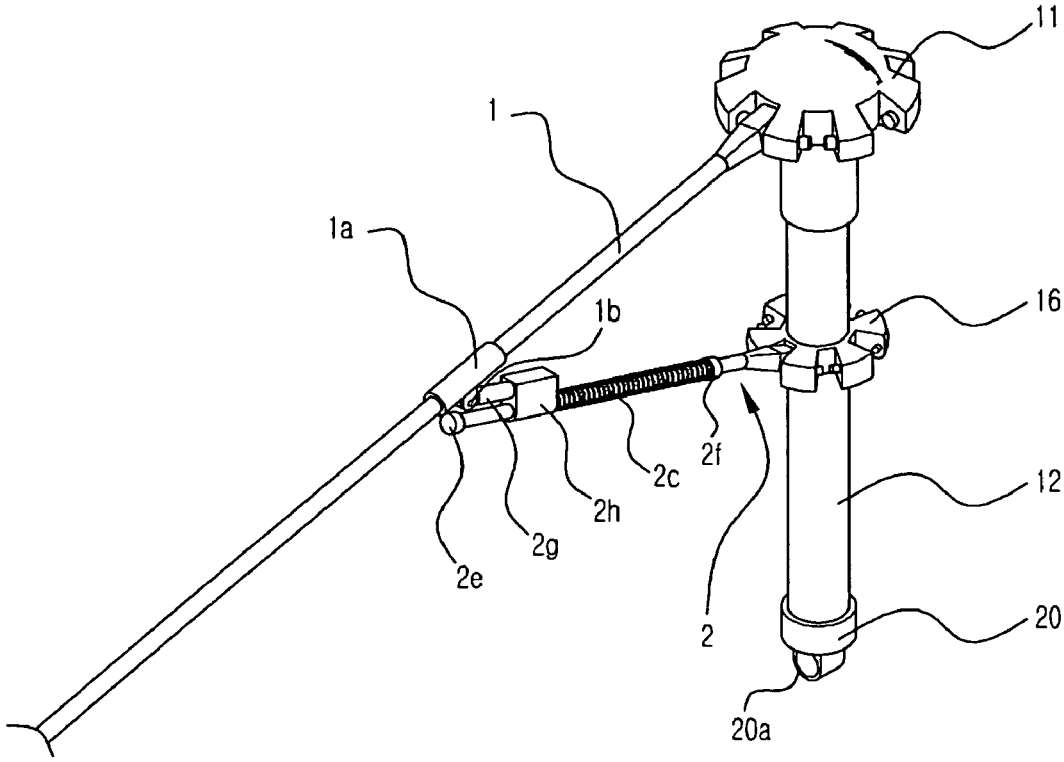
FIG. 13 is a perspective view illustrating the assembled frame of FIG. 12.

FIG. 12 is an exploded perspective view illustrating the important elements of a frame for automatic umbrella style canopy tents, according to the third embodiment of the present invention. FIG. 13 is a perspective view illustrating the assembled frame of FIG. 12.

As shown in the drawings, the general shape of the frame for automatic umbrella style canopy tents according to the third embodiment of the present invention remains the same as that described for the first and second embodiments, but each of the spreaders 2 is configured as an integrated structure which comprises a front stopper 2*e* provided at the front end of the spreader 2 coupled to the hinge joint 1*a* of the upper rib 1, and a rear stopper 2*f* provided at the rear end of the spreader coupled to the spreader holder 16. A movable block 2*h*, which is integrated with a coupling rod 2*g* and coupled to the hinge joint 1*a*, is provided on the spreader 2 at a position between the front and rear stoppers 2*e* and 2*f*, so that the block 2*h* moves along the spreader 2. A spring 2*c* is fitted over the spreader 2 at a position behind the movable block 2*h*, thus causing the movable block 2*h* to be elastically movable.

In the same manner as that described for the first and second embodiments of the present invention, the frame for automatic umbrella style canopy tents according to the third embodiment of the present invention includes a spreader holder 16 which is integrated with a plurality of hinge block parts and is movably fitted over the shank part of the connection member 12.

The rear ends of the spreaders 2 are thus coupled by hinges to the block parts of the spreader holder 16, while the coupling rods 2*g* of the movable blocks 2*h* provided at the front ends of the spreaders 2 are coupled to the hinge joints 1*a* of the upper ribs 1 using a plurality of locking pins 1*b*. In the above state, a spring 2*c* is fitted over each of the spreaders 2 at a position behind the movable block 2*h*, so that the extendible structure of the spreader 2 shown in FIG. 13 is provided.

The above-mentioned parts of the tent frame according to the third embodiment are assembled into a single structure in the same manner as that described for the first embodiment of the present invention, and further explanation is thus deemed not necessary.

The operation of the automatic umbrella style canopy tent according to the third embodiment of the present invention having the above-mentioned construction and assembled structure will be described herein below.

Figure 14:
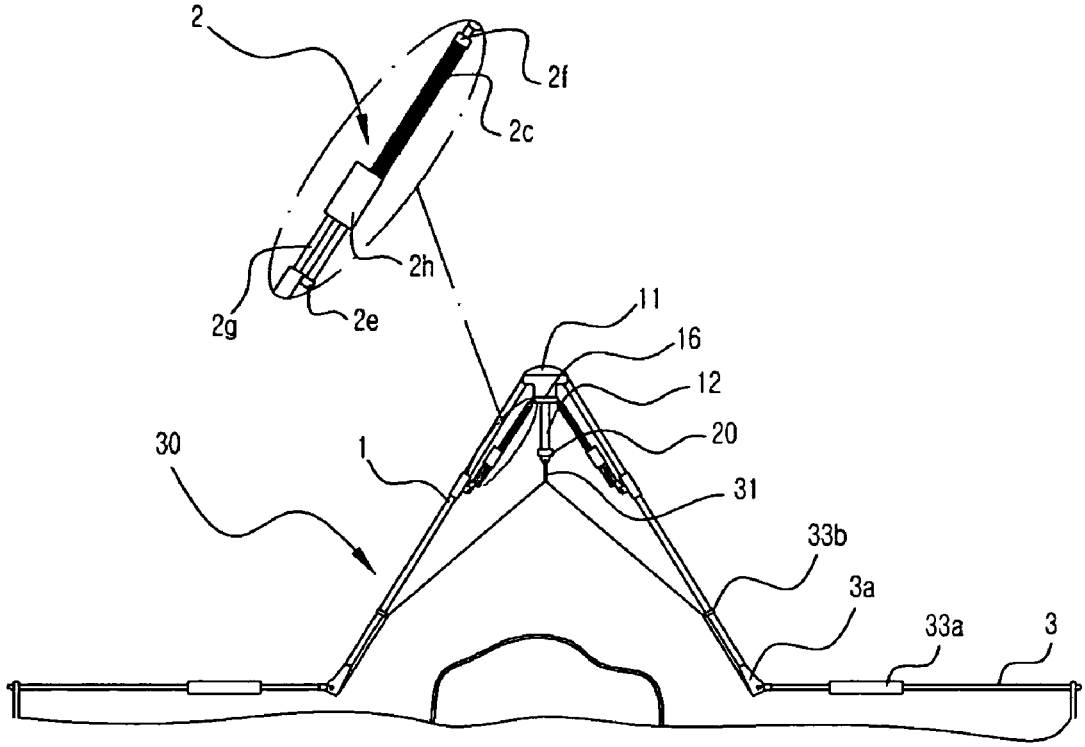
FIG. 14 is a front view illustrating the frame according to the third embodiment of the present invention when a tent having the frame is collapsed.
Figure 15:
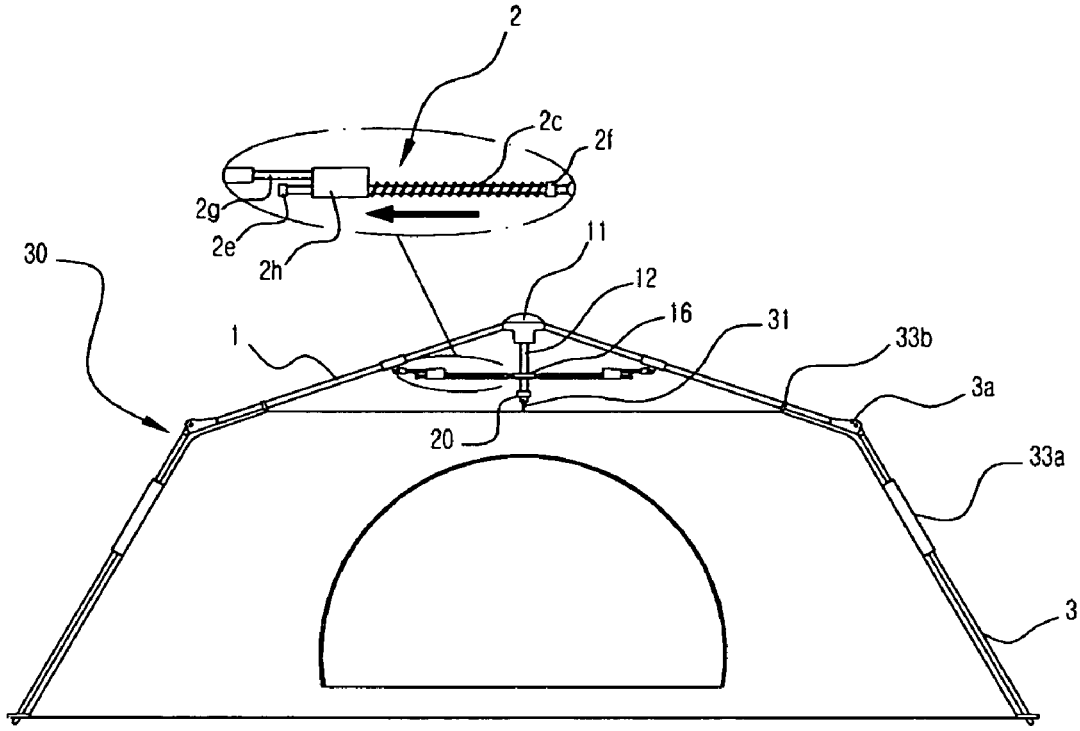
FIG. 15 is a front view illustrating the frame according to the third embodiment of the present invention when the tent having the frame is fully pitched.

FIG. 14 is a front view illustrating the automatic umbrella style canopy tent having the frame according to the third embodiment of the present invention when the tent is collapsed. FIG. 15 is a front view illustrating the automatic umbrella style canopy tent having the frame according to the third embodiment of the present invention when the tent is fully pitched.

First, when the user desires to close the pitched tent, the tent frame according to the third embodiment of the present invention is manipulated in the same manner as that described for the first and second embodiments.

Described in detail, to close the pitched tent, a user holds any two diametrically opposite upper ribs 1 at positions around the lower parts of the upper ribs 1, and forces the two selected upper ribs 1 inwards and downwards. In the above case, the spreader holder 16, fitted over the shank part of the connection member 12 and movable upwards and downwards along the shank part, is moved upwards along the shank part as the spreader holder 16 is forced upwards by the spreaders 2 coupled by hinges to the upper ribs 1.

During the above-mentioned action (the action of closing the upper ribs), both the coupling rods 2*g* and the movable blocks 2*h* integrated with the rods 2*g* are moved along with the upper ribs 1 due to the folding force of the upper ribs 1, and the spreader holder 16 moves upwards. In the above case, the range of upward movement of the spreader holder 16 is limited by the lower shoulder of the rib holder 11, so that the springs 2*c* fitted over the spreaders 2 are compressed by the movable blocks 2*h* and maintained in the compressed state, as shown in FIG. 14.

When a user desires to pitch the closed tent according to the third embodiment of the present invention, the tent frame is manipulated as follows.

As shown in FIG. 15, to pitch the closed tent which is in contact with the upper ribs 1 (in the state of FIG. 14), the user opens the folded lower ribs 3 from the closed upper ribs 1 by forcing the ends of the folded lower ribs 3 outwards and downwards, and holds any two diametrically opposite upper ribs 1 at lower parts of the upper ribs 1 prior to forcing the two selected upper ribs 1 upwards and outwards. The spreader holder 16 is moved downwards along the shank part of the connection member 12. During the downward movement of the spreader holder 16 along the shank part of the connection member, the spreader holder 16 pushes the spreaders 2 toward the upper ribs 1.

In the above case, the movable blocks 2*h*, which have compressed the springs 2*c* as shown in FIG. 14, elastically move outwards (as shown by the arrow of FIG. 15) along the spreaders 2 due to the restoring force of the springs 2*c*. During the above-mentioned movement of the movable blocks 2*h*, the coupling rods 2*g* integrated with the movable blocks 2*h* move along with the blocks 2*h*, thus naturally expanding the upper ribs 1 in radial directions.

In other words, because the folding force of the upper ribs 1 is removed, the coupling rods 2*g* of the movable blocks 2*h* are elastically pushed by the restoring force of the springs 2*c* and bias the upper ribs 1 upwards and outwards.

Thus, all of the upper ribs 1 are elastically rotated upwards around the hinges of the rib holder and fully opened at one time, so that the automatic umbrella style canopy tent 30 according to the third embodiment of the present invention is fully pitched.

Furthermore, as shown in FIG. 15, a repulsive force acts both on the coupling rod 2*g* of the movable block 2*h* and on the spreader 2 due to the restoring force of the spring 2*c* when the tent 30 is in a fully pitched state, so that the spreader holder 16 can be prevented from being undesirably moved upwards in the same manner as that described for the first and second embodiments.

In other words, the repulsive force, which acts both on the coupling rod 2*g* of the movable block 2*h* and on the spreader 2 due to the restoring force of the spring 2*c* when the tent is pitched, restricts the upward movement of the spreader holder 16, thus securely maintaining the locked state of the tent frame, so that the pitched tent 30 can be prevented from being undesirably closed.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A frame for automatic umbrella style canopy tents, comprising: a rib holder with a plurality of upper ribs rotatably coupled to the rib holder in radial directions; a connection member mounted to the rib holder; a spreader holder engaging with the connection member and being movable upwards and downwards; a plurality of spreaders each coupled at respective ends thereof to a corresponding upper rib and to the spreader holder, thus expanding or closing the upper ribs in radial directions in response to upward or downward movement of the spreader holder; and a stopper mounted to a lower end of the connection member and preventing the spreader holder from being removed from the connection member, wherein each of the spreaders comprises: front and rear stoppers provided at front and rear ends of the spreader, respectively; a movable block provided on the spreader at a position between the front and rear stoppers and integrated with a coupling rod coupled to each of the upper ribs; and a spring provided on the spreader at a position behind the movable block, thus allowing the movable block to be movable.

2. The frame for automatic umbrella style canopy tents according to claim 1, further comprising: a rope connector mounted to a lower end of the stopper and holding a tension rope which extends from a center of a ceiling part of a canopy of a tent, thus preventing the center of the ceiling part of the canopy from sagging when the tent is pitched.

3. An automatic umbrella style canopy tent comprising the frame of claim 1.

* * * * *